US008083323B2

(12) United States Patent
Gulvin et al.

(10) Patent No.: US 8,083,323 B2
(45) Date of Patent: Dec. 27, 2011

(54) ON-CHIP HEATER AND THERMISTORS FOR INKJET

(75) Inventors: Peter M. Gulvin, Webster, NY (US); Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 77 days.

(21) Appl. No.: 12/240,322

(22) Filed: Sep. 29, 2008

(65) Prior Publication Data

US 2010/0079533 A1 Apr. 1, 2010

(51) Int. Cl.
*B41J 2/05* (2006.01)
*B41J 2/04* (2006.01)
*B41J 29/393* (2006.01)

(52) U.S. Cl. ..... 347/60; 347/19; 347/54; 347/67

(58) Field of Classification Search ..... 347/60, 347/67

See application file for complete search history.

(56) References Cited

U.S. PATENT DOCUMENTS

| | | | | |
|---|---|---|---|---|
| 5,191,360 | A * | 3/1993 | Pohlig | 347/67 |
| 5,208,611 | A * | 5/1993 | Kappel et al. | 347/67 |
| 5,880,753 | A * | 3/1999 | Ikeda et al. | 347/17 |
| 6,315,396 | B1 * | 11/2001 | Ozaki et al. | 347/60 |
| 6,467,879 | B1 | 10/2002 | Kubby et al. | |
| 6,508,947 | B2 | 1/2003 | Gulvin et al. | |
| 6,513,898 | B1 * | 2/2003 | Vigna et al. | 347/67 |
| 7,267,430 | B2 | 9/2007 | Parish | |
| 2002/0096488 | A1 | 7/2002 | Gulvin et al. | |
| 2005/0031288 | A1 | 2/2005 | Kubby et al. | |
| 2006/0017774 | A1 * | 1/2006 | Beak | 347/44 |
| 2007/0263038 | A1 * | 11/2007 | Bibl | 347/56 |
| 2009/0051723 | A1 * | 2/2009 | Sugahara | 347/17 |

FOREIGN PATENT DOCUMENTS

| | | | |
|---|---|---|---|
| JP | 04250061 A | * | 9/1992 |
| JP | 2009000833 A | * | 1/2009 |

* cited by examiner

*Primary Examiner* — Shelby Fidler
(74) *Attorney, Agent, or Firm* — MH2 Technology Law Group LLP

(57) ABSTRACT

A chip used for dispensing a fluid such as ink provides ink-dispensing ejectors having an ink cavity over a supporting substrate, and further provides a heater for heating the ink in the cavity. The heater can be interposed between the substrate and the ink cavity to provide direct heating of ink as it is being dispensed. Various embodiments further comprise the use of the heater structure as a temperature probe to measure the temperature of the ink in the ink cavity. Other embodiments provides a chip having both a temperature probe and a heater as separate structures interposed between the ink cavity and the substrate. Further described is a temperature probe and/or heater which traverses a majority of a width of a substrate, and surrounds each drop ejector on at least two sides.

11 Claims, 5 Drawing Sheets

ON-CHIP HEATER AND THERMISTORS FOR INKJET

FIELD OF THE INVENTION

The present invention relates to devices for dispensing a fluid, and more particularly to inkjet print head devices.

BACKGROUND OF THE INVENTION

In inkjet printing, droplets of ink are selectively ejected from a plurality of drop ejectors (actuators) in a print head. The ejectors are operated in accordance with digital instructions to create a desired image on a print medium moving past the print head. The print head may move back and forth relative to the sheet in a typewriter fashion, or the linear array may be of a size extending across the entire width of a sheet to place the image on a sheet in a single pass. Additionally, multiple passes can be made to create a higher resolution image than the inherent resolution of the printhead.

The ejectors typically comprise a nozzle plate providing a plurality of nozzles, with each nozzle having drop ejection aperture (nozzle aperture), and one or more common ink supply manifolds. Ink supplied from the manifold travels through one or more tubes or conduits and is retained within a different channel for each ejector until there is a response by the ejector to an appropriate signal. In one embodiment of the ejector, the ink drop is ejected by a pressure change which results from a displacement of an electrostatically or magnetostatically actuated deformable membrane. The deformable membrane forms one electrode of a capacitor, with a counter electrode forming a second electrode. In MEMSJet technology, the nozzle plate and membrane can be manufactured from silicon. The nozzle plate can alternatively be made of a polymer layer with laser-drilled nozzle apertures. Each ejector further includes an ink cavity between the membrane and the nozzle plate. When the bias voltage is applied between the membrane and the counter electrode, the membrane deflects and increases the size of the ink cavity, which draws in a larger volume of ink. When the bias voltage is removed, the relaxation of the membrane pressurizes the fluid and causes a liquid drop to be formed and ejected out of the nozzle aperture onto a rotating drum, a moving belt, or paper.

This capacitor structure which incorporates the deformable membrane for silicon-based ejectors can be fabricated in a standard polysilicon surface micro-machining process as a micro electromechanical system (MEMS). A device can be batch fabricated at low cost using existing silicon foundry capabilities. The surface micro-machining process has proven to be compatible with integrated microelectronics, allowing for the monolithic integration of the ejector with associated addressing electronics.

It is desirable to dispense ink from the ejector at a temperature which is within a few degrees of a target temperature. For solid ink, the target temperature is typically between about 105° C. and 140° C. To assist in maintaining the ink temperature to within a tolerance of a desired temperature, the temperature of the print head is maintained using a relatively large block heater, for example comprising stainless steel, located on the print head which provides heating. Further, an inkjet device can comprise heaters wrapped around ink tubes leading to the print head.

New ways of providing improved control over the flow of dispensed ink from an inkjet print head, or another fluid in other fluid dispensing systems, would be desirable.

SUMMARY OF THE EMBODIMENTS

In accordance with the present teachings, a chip for dispensing a fluid such as an ink drop is provided.

In one particular embodiment, a print head for dispensing ink comprises a substrate and a plurality of ink ejectors over the substrate, with each ejector adapted to eject ink from a nozzle aperture. In ink heater, over or within the substrate and interposed between the plurality of ejectors and the substrate, is adapted to activate and deactivate during ejection of ink from the nozzle aperture.

In another embodiment, a print head for dispensing ink comprises a substrate an ink cavity over the substrate, and an ink heater comprising a first conductive line having a first end electrically coupled with a first conductive pad and a second end electrically coupled with a second conductive pad. This embodiment further comprises a temperature probe comprising a second conductive line having a third end electrically coupled with a third conductive pad and a fourth end electrically coupled with a four conductive pad. The first conductive line of the heater and the second conductive line of the temperature probe are interposed between the substrate and the ink cavity.

Yet another embodiment comprises a print head for dispensing ink comprising a substrate having a width, a plurality of drop ejectors over the substrate, and an ink heater comprising a conductive line having a first end electrically coupled with a first conductive pad and a second end electrically coupled with a second conductive pad, wherein the conductive line traverses a majority of the width of the substrate and, in plan view, surrounds each of the plurality of drop ejectors on at least two sides.

In an embodiment of a method for dispensing ink to form a patterned image, a semiconductor chip is provided. The semiconductor chip comprises a semiconductor substrate, a nozzle plate having a nozzle aperture therein overlying the semiconductor substrate, an ink cavity, an ink heater interposed between the semiconductor substrate and the ink cavity, and a temperature probe interposed between the semiconductor substrate and the ink cavity. While ejecting ink out of the nozzle aperture, the temperature probe is activated to measure a temperature of the ink flowing through the ink cavity and out of the nozzle aperture. Further, while ejecting ink out of the nozzle aperture, the heater is activated to heat the ink flowing through the ink cavity and out of the nozzle aperture.

In an embodiment of a method for printing an image using a printer for dispensing a quantity of ink, a first rate at which ink will flow through an ink-dispensing nozzle aperture located on a semiconductor substrate to print a first part of an image is determined. In response to the first rate, a heater located on the semiconductor substrate is activated. A second rate at which ink will flow through the ink-dispensing nozzle aperture to print a second part of the image is determined and, in response to the second rate, the heater is deactivated.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and, together with the description, serve to explain the principles of the invention. In the figures.

Figure 1:
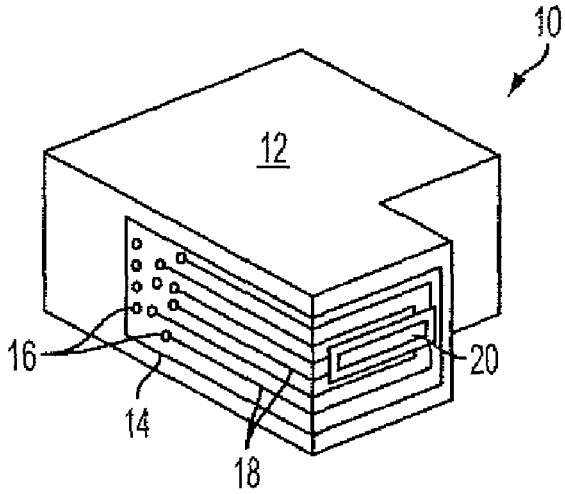
FIG. 1 is a perspective view of a print head comprising a chip in accordance with an embodiment of the invention.

Because the features of each embodiment can vary greatly in scale and complexity, it should be noted that some details of the FIGS. have been simplified and are drawn to facilitate understanding of the inventive embodiments rather than to maintain strict structural accuracy, detail, and scale.

DESCRIPTION OF THE EMBODIMENTS

The Applicants realize that a new approach needs to be taken for the ink dispensing process to better maintain the temperature of the ink as it is being dispensed. It has been realized that the viscosity of the ink changes substantially with even a minimum temperature variation. To achieve reproducible jetting, the ink temperature should be controlled to within a few degrees.

The thermal resistance between the MEMSJet chip and the conventional heaters (which heat the ink by heating the overall print head and the ink supply feeding the devices) can result in the ink located in the ink cavities of the MEMSJet chip having a different temperature than the ink in the rest of the system. Temperature gradients resulting from this thermal resistance can result in the ink at the surface of the MEMSJet chip being between 10° C. and 20° C. cooler than the ink supply in the rest of the system. In systems using a drum, one source of this thermal difference may be heat loss resulting from a cooler rotating drum, which is typically heated to about 60° C., and which can be less than one millimeter away from the chip. Heat loss from the MEMSJet chip to the rotating drum, and the thermal resistance between the MEMSJet chip and the conventional heaters, can result in dispensing of the ink at a temperature which is lower than desired. This, in turn, can result in lower velocity ink drops, decreased drop directionality, and reduced print quality.

Additionally, it has been realized that the quantity of heated ink flowing through the head can also affect the temperature of the chip. The rate at which liquid ink flows through the apertures in the nozzle plate can vary greatly, for example depending on whether the head is printing solid fill (activation of every ejector) or printing a 1/16 halftone (typically activation of one out of 4 ejectors for every 4 pixels). Dispensing a large quantity of ink in a heavy pattern results in the ink from the print head better maintaining its temperature as it flows through the ejector and out of the nozzle aperture. Conversely, if a low quantity of ink is flowing from the print head, to the chip, and out of the nozzle aperture, the cooler rotating drum has a greater effect on the temperature of the ink within the ink cavity of the ejector. Thus the pattern and quantity of ink being printed, whether a heavy pattern or a light pattern, directly affects the temperature of the MEMSJet chip and thus the ink being dispensed from the ink cavities.

Additionally, to control the temperature of the MEMSJet chip an accurate temperature measurement must be possible.

Reference will now be made in detail to the present embodiments (exemplary embodiments) of the invention, examples of which are illustrated in the accompanying drawings. Wherever possible, the same reference numbers will be used throughout the drawings to refer to the same or like parts.

FIG. 1 is a perspective depiction of an inkjet print head 10 comprising an ink supply reservoir 12 and a flexible (flex) circuit 14 such as a tape automated bonding (TAB) flex circuit. The flex circuit 14 comprises external I/O contacts 16 and internal interconnects 18, which route signals between the external I/O contacts 16 and a chip 20 such as a MEMSJet chip comprising a silicon substrate formed from a diced semiconductor wafer and formed in accordance with the invention.

Figure 2:
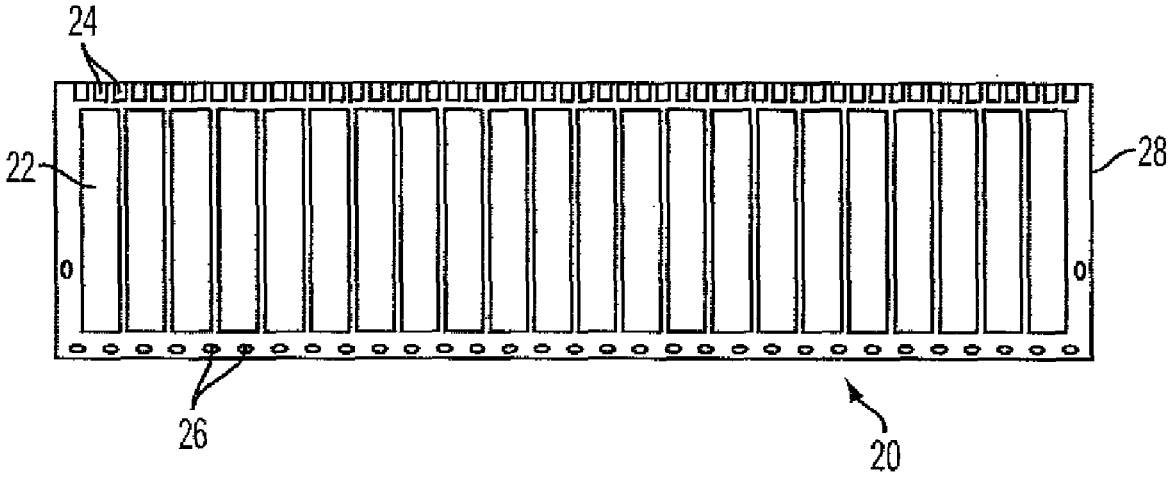
FIG. 2 is a magnified plan view of the chip of FIG. 1.

FIG. 2 is a schematic plan view of the chip 20 which, in this illustrative embodiment, comprises MEMSJet technology to dispense a quantity of ink. The FIG. 2 view is a schematic view, as various features of the chip which are not immediately germane to the present embodiment of the invention are depicted either in simplified form, or not at all. MEMSJet technology is described in U.S. Ser. No. 09/768,688 filed Jan. 24, 2001 and issued Jul. 25, 2002 as U.S. Pat. No. 6,508,947, which is incorporated herein by reference as if set forth in its entirety. Various embodiments of the present invention can be applied to other ink dispensing technologies, and possibly to other fluid dispensing mechanisms, where it is useful to accurately control the temperature of a fluid as it is dispensed. However, the embodiments described herein will be in reference to MEMSJet chips.

Figure 3:
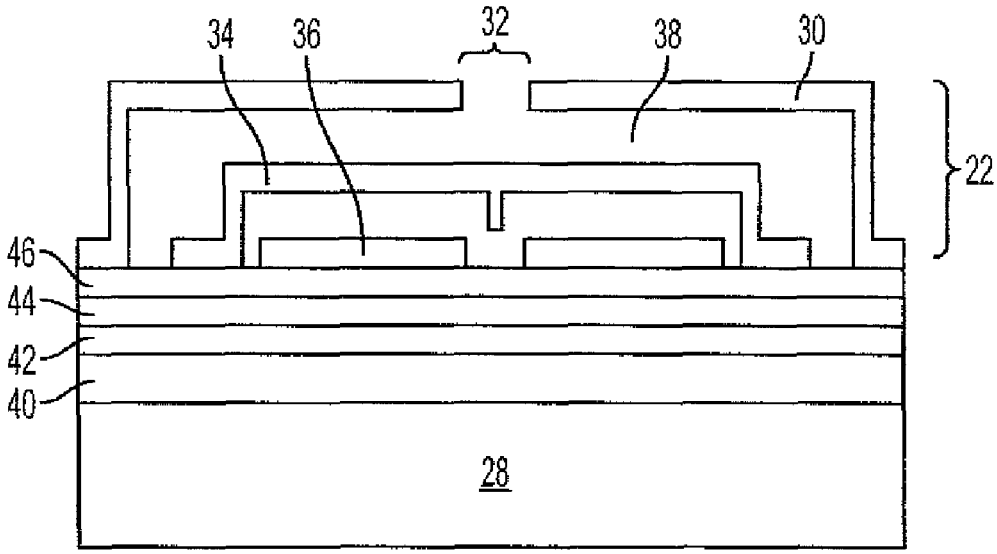
FIG. 3 is a cross section depicting a MEMSJet drop ejector which, in one embodiment, can be formed on the chip of FIG. 2.

The chip 20 of FIG. 2 comprises various structures, a portion of which are depicted in the magnified cross section of FIG. 3 which depicts a single fluid ejector. MEMSJet ejectors 22, conductive edge contacts 24, and openings 26 are formed on a semiconductor wafer substrate 28 such as a silicon or gallium arsenide substrate. The number of ejectors depends on the device design. In one particular embodiment, the chip can comprise 96 or more ejectors. The ejectors 22 comprise a nozzle plate 30 having an nozzle aperture 32 and a membrane 34. The nozzle plate 30 covers the majority of the surface of the chip 20 to hold in the ink, which is transferred from the supply reservoir at the back of the chip to the front of the chip through openings 26.

In use, the membrane 34 deflects in response to a voltage applied to an electrode 36 through one or more of the edge contacts 24, then returns to its original position when the electrode is grounded. During deflection, the membrane decreases the pressure in an ink cavity 38 between the nozzle plate 30 and the membrane 34 to draw in an additional amount of ink between the membrane 34 and the nozzle plate 30 through a channel (not individually depicted). When the electrode 36 goes from having a voltage applied to being grounded, the membrane 34 returns to its original position to eject an amount of ink from the nozzle aperture 32. In one exemplary embodiment using current technology, the ejector can eject about 110,000 individual drops every second. A drop ejected by an ejector having a particular configuration can have a volume of about 13 picoliters (pL).

Regardless of the mechanism used for ejecting ink (or other substances), various embodiments of the present invention can comprise the use of a structure on the chip to measure and/or control the temperature of the ink at the chip level. In various embodiments, the structure can comprise a single resistor for heating the ink. In another embodiment, a single resistor for heating the ink and also for measuring temperature is provided. Additionally, an embodiment can also comprise a pair (or more) of resistors, one for heating the ink and one for measuring temperature.

Figure 4:
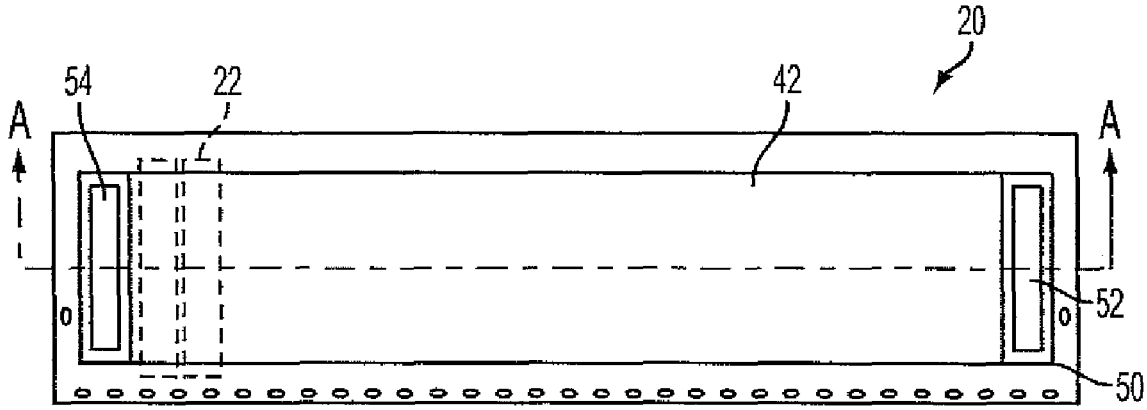
FIG. 4 is a plan view depicting a layer formed prior to formation of the drop ejectors of FIG. 2.
Figure 5:
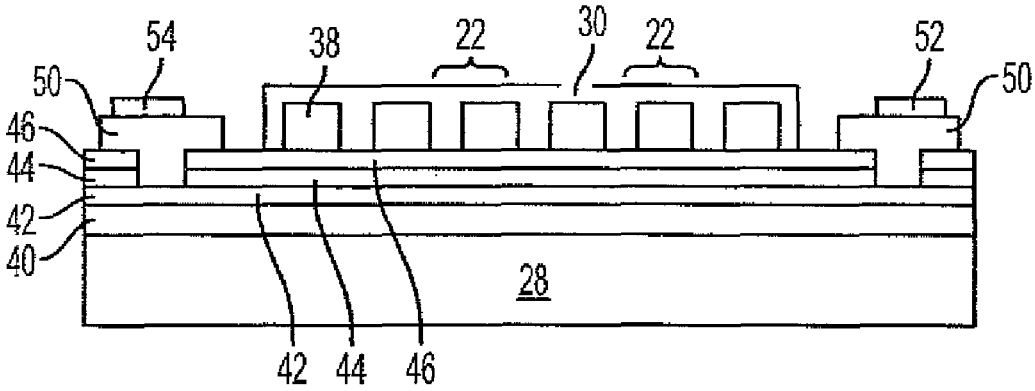
FIG. 5 is schematic cross section across A-A of FIG. 4 depicting various structures and layers in accordance with an embodiment of the invention.

The embodiment of the invention depicted in FIGS. 3-5 can be implemented using additional conductive and dielectric layers formed between the substrate 28 and surface structures 22 in accordance with known manufacturing techniques. In this embodiment, a single resistor will be used both for heating the ink and measuring temperature.

FIG. 3 depicts layers 40-46, with layer 42 comprising a conductive layer and layers 40, 44, and 46 comprising dielectric layers. In this embodiment, dielectric layers 40, 44 can each comprise silicon dioxide between about 1,000 Å and about 15,000 Å thick. Layer 46 can comprise silicon nitride between about 1,000 Å and about 5,000 Å thick. Conductive layer 42 can comprise polysilicon between about 1,000 Å and about 10,000 Å thick, or a metal such as aluminum, gold, or copper between about 500 Å and about 15,000 Å thick. The materials and thickness discussed herein are exemplary, and can vary depending on the specific device and its method of formation.

FIG. 4 depicts a schematic plan view of chip 20 of FIG. 1, with the ejectors 22 in outline, and FIG. 5 depicts a schematic cross section of the FIG. 4 along A-A of FIG. 4, omitting the electrodes, membranes, and the nozzle apertures. The present embodiment comprises layers 40-44 of FIG. 3, as well as additional conductive layers 50, 52, and 54. Thus the heater adjusts the temperature of the ink and is separate from the ejector mechanism.

The structure of FIG. 5 can be formed using conventional semiconductor manufacturing technology. First, dielectric layer 40 is formed over the substrate 28. Optionally, dielectric layer 40 can be patterned with photoresist and etched to allow connections to the substrate 28. Next, conductive layer 42 is formed, and optionally doped as necessary to reach the desired resistivity. Conductive layer 42 can then optionally be patterned with photoresist and etched to define the extents of the resistors. Subsequently, dielectric layer 44 is formed, patterned with photoresist, and etched to expose portions of conductive layer 42 to allow electrical connections to be made thereto. Conventional processing is performed to provide the ejector electrodes 36 and membranes 34, and to form sacrificial layers (not individually depicted) which will allow formation of the air cavities underneath the membranes 34 that allow the membranes 34 the freedom to move. To form conductive landing pads (bond pads) 52, 54, a metal layer such as aluminum can be patterned on conductive layer 50 to form individual landing pads 52, 54.

To create the ink cavity 38, nozzle plate 30, and nozzle apertures 32, any one of a number of different approaches can be used. For example, the cavities 38 can be etched into an individual substrate which can then be wafer-bonded to the existing assembly shown in FIG. 5. The substrate can then be ground and polished to create the desired nozzle plate 30 thickness. The nozzle apertures 32 can be patterned with photoresist and etched through the nozzle plate 30. As an alternative illustrative example, sidewalls can be created by spinning on a photoimageable polymer such as SU-8 (available from Shell Chemical Co. of Houston, Tex.), then patterning and developing away areas to create the ink cavity 38. The nozzle apertures can be formed in a separate layer using a method such as laser ablation, and then the nozzle plate can be bonded on top of the polymer walls to complete the ink cavity 38.

It should be noted that the routing of one or more of conductive layers 42, 50, 52, and 54 can be to any desired location, for example to the edge of the chip 20 as depicted in FIG. 1, so that the conductive pads 52, 54 are provided as one of the conductive edge contacts 24.

In use, structures 40-54 can be used as a heater to heat the ink at the surface of the chip 20, for example the ink within each ink cavity 38 of each drop ejector 22. In one embodiment, the heater is used in an attempt to heat the ink within all ink cavities to the same temperature at the same time. Additionally, the structures as described and depicted can instead perform the function of a temperature probe to measure an average temperature of the ink in the ink cavities, rather than forming a heater. In another embodiment, the structures are adapted for use as both an ink heater and as a temperature probe.

For use as a heater, a voltage such as 110 V is applied across the first 52 and second 54 bond pads. The current through, and internal resistance of, conductive layer 42 results in a heating of layer 42. The thermal energy will conduct from conductive layer 42 through dielectric layers 44, 46 to heat the ink within ink cavity 38. The amount of heating provided by layer 42 can be adjusted by varying an amount of impurity doping of polysilicon layer 42 during device manufacture, with a lower resistance increasing the amount of heating for a given voltage. If metal is used, the resistance can be determined by the thickness of the metal layer and the electrical conductivity of the material used.

Because the conductive layer 42 which is used as a heater is interposed between (i.e. directly between) the substrate and the ink cavities, and thus in close proximity to the ink, it provides direct heating of the ink at the chip level just prior to the ink being dispensed. Further, the substrate, such as a silicon-based substrate, is a good thermal conductor. With the application of heat by the heater(s) as described, the temperature of the substrate (and thus the ink in the ink cavities) reaches equilibrium across the chip and can be maintained to within a reasonable tolerance of a desired temperature.

For use as a thermistor temperature probe, the resistance of the conductive line is measured, and will have a value which varies with temperature. Depending on the material used, the resistivity can increase or decrease with increasing temperature. Polysilicon, for example, can have higher resistivities at higher temperatures, depending on the dopant type and temperature range of interest. For polysilicon thermistors, the on-chip heater or external heater will turn on (activate) when the thermistor resistance drops to a lower control limit which is some small amount less than a previously measured resistance value for the nominal temperature. The on-chip or external heater will turn off (deactivate) when the resistance value exceeds the upper control limit, which would be set at some small amount higher than the resistance at the nominal temperature. To determine the resistance at the nominal temperature, the resistance value can be read while the entire printhead sits in an oven at the nominal temperature. To determine the upper and lower control limits, the resistance values can be measured when the oven is set at the minimum and maximum allowable temperatures, which would in turn be decided based on some other metric such as image quality.

Figure 6:
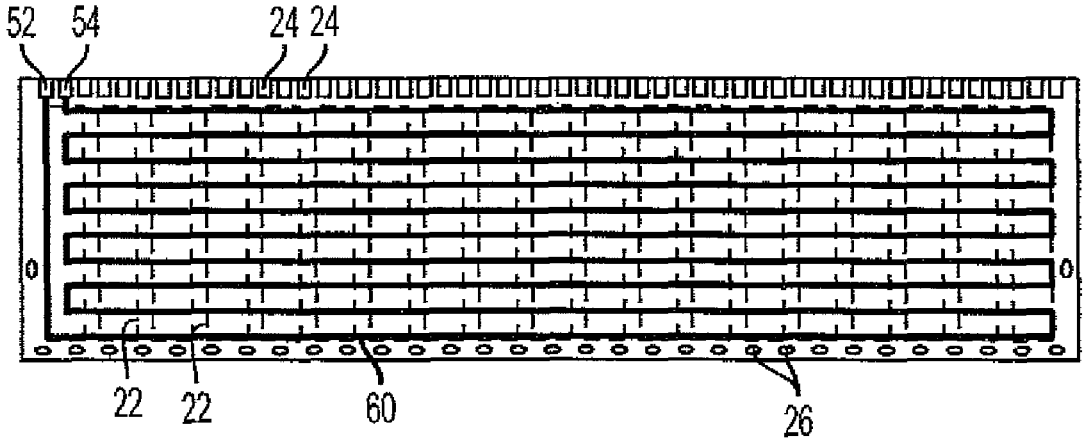
FIG. 6 is a plan view of a chip in accordance with another embodiment of the invention.

Various other designs for implementing embodiments of the invention are also possible, for example using the conductive layer 60 as depicted in FIG. 6. In this particular exemplary embodiment, conductive layer 60 has a width which is narrower than layer 42 of FIG. 4, and which folds or serpentines back and forth 10 times across the width of the ejector array, with the number of folds and width of the conductive line being variable depending on the device design. As an example, if 10 folds are formed with a conductive layer which has a width which is $1/10^{th}$ the width of the original of FIG. 4, the resistance will be 100 times larger. Using the formula $P=V^2/R$ (where "P" is power, "V" is voltage, and "R" is resistance), in order to maintain equal power the voltage would have to be 10 times higher to overcome the increase in resistance. However, the current requirement would decrease to 1/10 of that required for the single wide sheet design of FIG. 4. Depending whether the drive electronics are high current or high voltage, a single wide sheet or a folded design could be used respectively.

Figure 7:
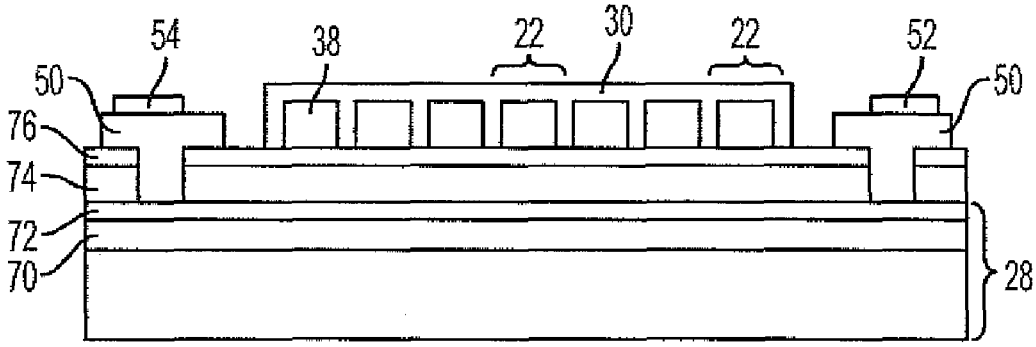
FIG. 7 is a schematic cross section depicting various structures and layers in accordance with another embodiment of the invention.

FIG. 7 depicts another illustrative embodiment of the invention, for example which can provide the functionality of the FIG. 4 structure using substrate doping rather than a conductive layer formed on or over the substrate. In this embodiment, the semiconductor wafer substrate 28 is implanted to form a first doped region 70 having a first type conductivity, for example with a p-type dopant such as boron to a concentration of between about 1E13 atoms/$cm^3$ and about 1E20 atoms/$cm^3$ to a depth of between about 1000 Å and about 20,000 Å. Next, the upper surface of substrate 28 is implanted to counter dope an upper portion of region 70 and to form a second doped region 72 having a second type conductivity, opposite that of the first type conductivity. For example, region 72 can be doped with an n-type dopant such as arsenic or phosphorous to a concentration higher than that of the earlier p-type doping, or between about 1E14 atoms/$cm^3$ and about 1E21 atoms/$cm^3$ to a depth of between about 500 Å and about 15,000 Å. The second doped region 72 should be shallower than the first doped region 70 so as not to completely counter dope first doped region 70.

If needed, first 74 and second 76 blanket dielectric layers, such as silicon dioxide and silicon nitride, can be subsequently formed. For example, if later processing comprises exposure to HF for removing a sacrificial oxide, a top layer of oxide is avoided, and nitride can be used. The underlying oxide can be omitted in some cases, particularly if there is no further high temperature processing and the nitride is sufficiently thick to withstand the voltage difference across it. If further high temperature processing is to be performed, the underlying oxide can be used to reduce the dopant from diffusing into the nitride, which can result in leakage. Both silicon dioxide layer 74 and silicon nitride layer 76 can each be between about 500 Å and about 20,000 Å thick. In this embodiment, silicon dioxide layer 74 and silicon nitride layer 76 provide an electrical insulator between the substrate and the surface structures such as electrode 36 (FIG. 3), and also function as a barrier to prevent dopant migration from layer 72.

Next, a patterned photoresist (not individually depicted) is formed to expose via regions to the second doped region 72. The second 76 then first 74 dielectric layers are etched to expose second doped region 72 and to provide via openings. Next, via contacts 50 to the second doped regions 72 are formed. In a preferred embodiment where the nozzle plate 30 comprises polysilicon, layer 50 can also be formed from the polysilicon nozzle plate layer. Processing can continue in accordance with the embodiment of FIG. 5 to provide the FIG. 7 structure, including individual conductive landing pads (bond pads) 52, 54.

Depending on the layout pattern of the first 70 and second 72 doped regions, the use of the structure of FIG. 7 can be much as that described for the embodiment of FIG. 4. Structures 50, 54, 70, and 72 can be used as a heater to heat the ink supplied to the ejector 22, as a temperature probe to measure the temperature of the ink, or as both a heater and a temperature probe at different times, depending on the voltages applied to pads 52, 54.

For example, for use as a heater, a voltage such as 110 V is applied across the first 52 and second 54 bond pads. The current through, and internal resistance of, second doped region 72 results in a heating of doped region 72. The thermal energy will conduct from doped region 72 through dielectric layers 74 and 76 to heat the ink in ink cavities 38. The amount of heating provided by doped region 72 can be adjusted by varying the doping concentration in region 72 during device manufacture, with a lower resistance increasing the amount of heating. Because the doped region 72 within the substrate is interposed between the substrate 28 and the ink in ink cavities 38, it provides a direct heat source for the ink just prior to it being dispensed.

For use as a thermistor temperature probe, the resistance of the conductive line is measured, and will have a value which varies with temperature.

Using the FIG. 7 structures as both a temperature probe and a heater, the probe voltage is applied for an amount of time, then the heater voltage is applied for an amount of time. While it is possible that using the same structure as both a probe and a heater can result in spurious temperature readings due to a lag in the time it takes for a transfer of heat from the heater to surrounding structures, it is believed that only a short duration between the end of the heater voltage and the application of the probe voltage will be sufficient for the temperature of the system to reach stasis. A wait of from about 5 milliseconds (ms) and about 20 ms between the end of a heater cycle and the beginning of the temperature probe cycle should be sufficient.

In one exemplary use of the invention, the temperature probe function can be used only during development of the print head, with the heater function being used during both development and consumer use. During product development, the temperature of the ink can be monitored as a function of the flow of ink, for example whether the pattern being printed is solid or 1/16 halftone. Due to the rotating drum in close proximity to the chip, printing a 1/16 halftone results in the ink within the ink cavities being close to the cooler drum for a longer period of time, thus cooling the ink. In this embodiment, a function of the ink density being printed relative to the ink temperature measured by the temperature probe is plotted. In the consumer product, the function is coded within software or hardware so that the heater is activated and deactivated as needed to heat the ink within the ink cavities, depending on the density of the ink being printed. That is, the rate at which ink must be dispensed from the nozzle aperture to print a part of an image is compared with the coded information, for example from a lookup table, to determine the amount of time the heater must be activated to maintain the ink within a desired tolerance of a target temperature. The heater can then be cycled on and off as needed to maintain the ink temperature to within a tolerance of a desired temperature, with the amount of required heating (for example as a percentage of time the heater is activated or deactivated) being determined by comparing the flow rate of ink with the coded information.

In another exemplary use, the printer in the consumer product can use the resistor as a temperature probe to monitor the ink temperature at a given interval of time. The functionality of the heater can be activated and deactivated as necessary during printing to maintain the temperature of the ink within the ink cavities to within a desired range.

In yet another exemplary use, it may be determined that the ink remains at a temperature which is too low but stable, with the change in the flow of ink based on the pattern being printed not greatly affecting the ink temperature. In this instance, the heater can remain on at all times to apply a constant heat supply to the chip, and thus to the ink within the ink cavities of the ejectors.

Figure 8:
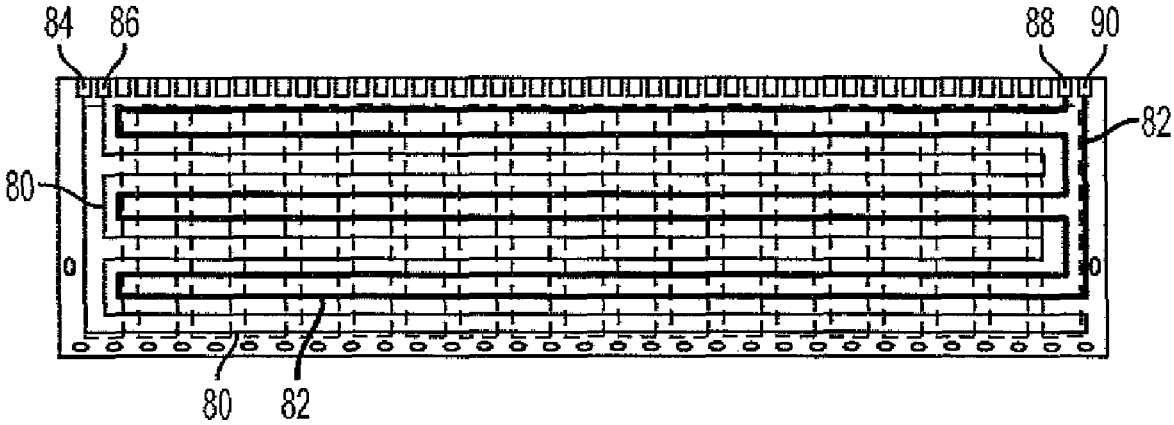
FIG. 8 depicts a plan view of a chip in accordance with an embodiment of the invention comprising discrete heater and temperature probe.

Another embodiment of the invention is depicted in FIG. 8, which can allow for more accurate temperature control than the previous embodiments. The FIG. 8 structure comprises both a temperature probe thermistor 80 for measuring temperature and a heater 82 for heating the ink within the ink cavities 38. FIG. 8 depicts interdigitated thermistor 80 and heater 82, although other design layouts are contemplated. With this embodiment, the heater may have a wider trace to provide a lower voltage heater, while the temperature probe may have a narrower trace to increase resistance and provide a greater resistance variation within the measurable temperature range, which can improve measurement accuracy.

In one embodiment, the conductive lines which form the temperature probe thermistor 80 and the heater 82 can be implemented using a polysilicon layer, similar to the implementation of the FIG. 5 structure. In another embodiment, the conductive lines which form the thermistor 80 and the heater 82 can be implemented by implanting the substrate, similar to the implementation of the FIG. 7 structure. It is also contemplated that a doped substrate can be used to implement one of the thermistor 80 and the heater 82, while a polysilicon layer is used to implement the other of the thermistor 80 and the heater 82.

Regardless of the implementation, FIG. 8 depicts first 84 and second 86 conductive edge contacts electrically coupled with ends of the conductive line 80 for use with the temperature probe thermistor, and third 88 and fourth 90 conductive edge contacts electrically coupled with ends of the conductive line 82 for use with the heater. The use of the probe 80 and heater 82 can be in accordance with previous embodiments. However, because the temperature can be monitored continuously, the temperature of the ink within the ink cavities 38 may be controlled more accurately.

In one exemplary use of the FIG. 8 embodiment, the reading from temperature probe thermistor 80 is read continuously, while the heater 82 is activated and deactivated as needed to maintain an ink temperature within a desired range.

In another use, the temperature probe is activated to measure the temperature of the ink flowing through the ink cavity as ink is being ejected out of the nozzle aperture. Also while ejecting ink out of the nozzle aperture, the heater is activated to heat the ink flowing through the ink cavity as ink is being ejected out of the nozzle aperture in response to the measured temperature. When the measured temperature is within a desired range, the heater is deactivated in response to the measured temperature.

Additionally, the various uses previously detailed can be implemented with the FIG. 8 embodiment of the invention as well.

In another embodiment, a temperature probe thermistor and/or heater thermistor can be formed on an upper surface of the chip, for example using a layer of polysilicon material which also forms the counter electrode 36 of FIG. 3. This layer can be routed from one of the edge contacts 24 (for example the leftmost edge contact), along a first outside edge of substrate 28 (for example the leftmost edge), between ejectors 22 and openings 26 along a second outside edge (for example the bottom edge), and along a third outside edge of the substrate 28 (for example the rightmost edge) to another edge connector contact 24 (for example the rightmost edge contact). Thus the temperature probe and/or heater, in plan view, would surround each ejector on at least three sides. In another similar embodiment, the temperature probe and/or heater, in plan view, can surround one, two, or three sides of each ejector 22, then fold back on itself, while having first and second ends which connect with different contact pads 24. In either case, the line for the temperature probe and/or heater can traverse across a majority of a width of the surface of substrate 28, for example more than 50% of the width of the substrate 28, to provide efficient heating of the ejectors 22, or accurate measurement of the ink within the ink cavities 38 of the ejectors 22.

An advantage of this embodiment is that it only requires a mask change, while forming layers underlying the ejectors as described in previous embodiments requires an additional mask and the formation of additional layers or dopant implantations. However, covering a greater percentage of the chip area is believed to provide greater heat control and more accurate temperature measurement.

Thus various embodiments of the heater as detailed herein may provide uniform heating across the ejector device array. Because the heater is in contact with (or only a few microns away from) the ink, the heating is much more direct than that provided by a printhead heater, which is separated from the chip by a number of layers of packaging. Similarly, the temperature probe thermistors can be in contact with (or within microns of) what they are intended to measure (temperature of the ink within the ink cavities) to provide a more accurate reading than a temperature probe located further from the chip or at a chip location further from the ejectors. Additionally, because the heater and/or temperature probe thermistor can span a large majority of the chip, the heater can provide uniform heating of the ink, and the temperature probe can provide an accurate average temperature of the ink within the ink cavities of all ejectors.

Figure 9:
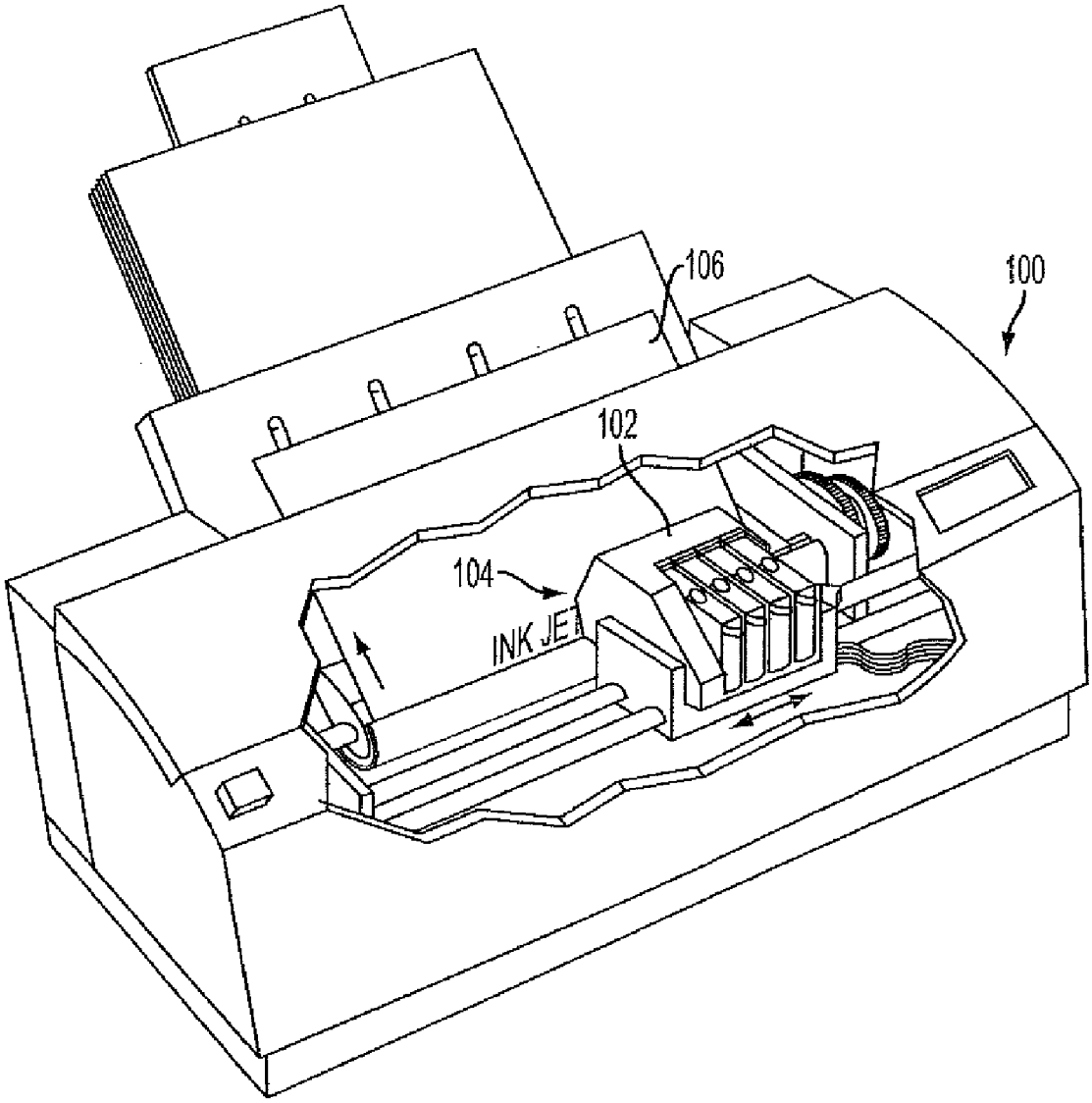
FIG. 9 is a perspective view of a printer with a drop ejector print head comprising embodiment of the invention.

FIG. 9 depicts a printer 100 comprising one or more print heads 102 and ink 104 being ejected from a chip (not individually depicted) in accordance with the invention. The chip is operated in accordance with digital instructions to create a desired image on a print medium 106 moving past the printhead 102. The print head 102 may move back and forth relative to the sheet in a scanning motion to generate the printed image swath by swath. Alternately, the print head 102 may be held fixed and the media 106 moved relative to it, creating an image as wide as the print head 102 in a single pass. The print head 102 can be narrower than, or as wide as, the print medium 106.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A print head for dispensing ink, comprising:

a substrate;

an ejector array over the substrate comprising a plurality of ejectors, each ejector of the plurality of ejectors configured to eject ink from a nozzle aperture, the ejector array comprising:

a nozzle plate overlying the substrate which provides a nozzle aperture for each of the plurality of ejectors; and a membrane interposed between the nozzle plate and the substrate;

a plurality of ink cavities provided at least in part by the nozzle plate and the membrane; and an ink heater arranged in thermal contact with the substrate and interposed directly between the plurality of ink cavities and the substrate and directly below the plurality of ink cavities, wherein the ink heater spans a majority of the ejector array and is configured to activate and to deactivate during ejection of ink from the ejector array in response to a measured ink temperature.

2. The print head of claim 1, wherein the ink heater comprises a conductive layer over the substrate.

3. The print head of claim 1 wherein the ink heater is configured to function as an ink heater and a temperature probe.

4. The print head of claim 1 wherein the ink heater comprises a single conductive line which is directly interposed between the substrate and the ejector array.

5. The print head of claim 1, wherein the ink heater comprises a continuous serpentine conductive layer.

6. The print head of claim 1, wherein the ink heater is configured to heat ink within each of the plurality of ink cavities of the print head to a same temperature at a same time.

7. A print head for dispensing ink, comprising:

a substrate having a width;

a plurality of drop ejectors over the substrate;

a nozzle plate over the substrate which provides a nozzle for each of the drop ejectors;

a membrane interposed between the nozzle plate and the substrate;

a plurality of ink cavities provided at least in part by the nozzle plate and the membrane; and an ink heater comprising a conductive line having a first end electrically coupled with a first conductive pad and a second end electrically coupled with a second conductive pad, wherein the conductive line traverses a majority of the width of the substrate and, in plan view, further surrounds each of the plurality of ink cavities on at least two sides, wherein the ink heater is configured to activate and deactivate during election of ink from the plurality of drop ejectors in response to a measured ink temperature.

8. The print head of claim 7 wherein, in plan view, the conductive line further surrounds each of the plurality of drop ejectors on at least three sides.

9. The print head of claim 7 wherein the ink heater is configured to activate and to deactivate during ejection of ink from the drop ejectors.

10. The print head of claim 7, wherein the conductive line comprises a continuous serpentine conductive line.

11. The print head of claim 7, wherein the ink heater is configured to heat ink within each of the plurality of ink cavities of the print head to a same temperature at a same time.

* * * * *